US005447393A

United States Patent [19]

Yeates et al.

[11] Patent Number: 5,447,393

[45] Date of Patent: Sep. 5, 1995

[54] BUILDING CONSTRUCTION METHODS AND MATERIALS

[76] Inventors: John A. Yeates; Milton M. Colson, both of 24 Raffles Pl., 15-00 Clifford Center, Singapore, Singapore

[21] Appl. No.: 140,054

[22] PCT Filed: Apr. 29, 1992

[86] PCT No.: PCT/AU92/00191

§ 371 Date: Oct. 29, 1993

§ 102(e) Date: Oct. 29, 1993

[87] PCT Pub. No.: WO92/19819

PCT Pub. Date: Nov. 12, 1992

[30] Foreign Application Priority Data

Apr. 29, 1991 [AU] Australia ..... PK5855

[51] Int. Cl.[6] ..... F02D 5/02

[52] U.S. Cl. ..... 405/276; 405/274; 405/281

[58] Field of Search ..... 405/274, 275, 278, 280, 405/281, 282, 283, 232

[56] References Cited

U.S. PATENT DOCUMENTS

| | | | |
|---|---|---|---|
| 1,085,493 | 1/1914 | Schiffler | 405/281 |
| 1,951,152 | 3/1934 | Janssen | 405/280 |
| 3,822,557 | 7/1974 | Frederick | 405/278 X |
| 4,419,030 | 12/1983 | Butkenper | 405/278 |

FOREIGN PATENT DOCUMENTS

| | | | |
|---|---|---|---|
| 4289315 | 10/1992 | Japan | 405/274 |

*Primary Examiner*—Dennis L. Taylor
*Attorney, Agent, or Firm*—Kimmel, Crowell & Weaver

[57] ABSTRACT

A wide sheet pile for the formation of buildings folded or formed from a metal plate or plates or by joining modular panels. The sheet pile is of corrugated form having upper and lower webs and joined by an inclined flange and provided on opposite sides with joining members and to enable the sheet pile to be connected to adjacent sheet piles. The sheet pile may incorporate a lateral stiffener or stiffeners. There is also disclosed pile driving apparatus for driving a sheet pile member into the ground, said apparatus including a pile driving frame for supporting drive means for applying a driving force to a said sheet pile member and means for coupling said pile driving frame to an adjacent said sheet pile member in the ground.

24 Claims, 14 Drawing Sheets

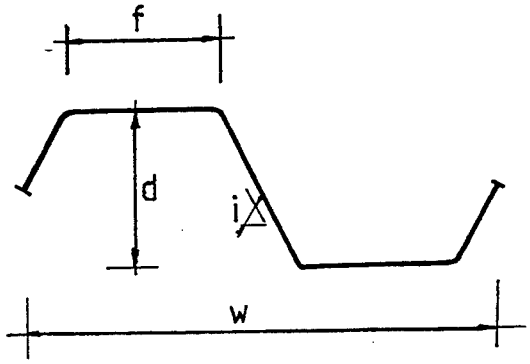
FIG.1a
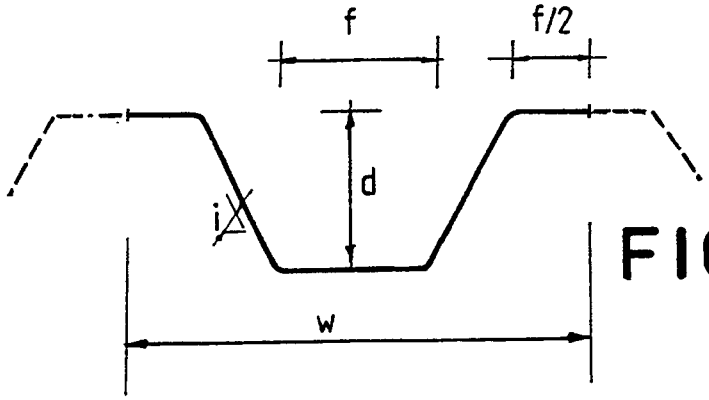
FIG.1b
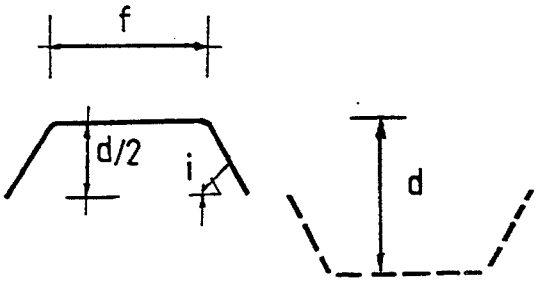
FIG.1c
FIG.1d
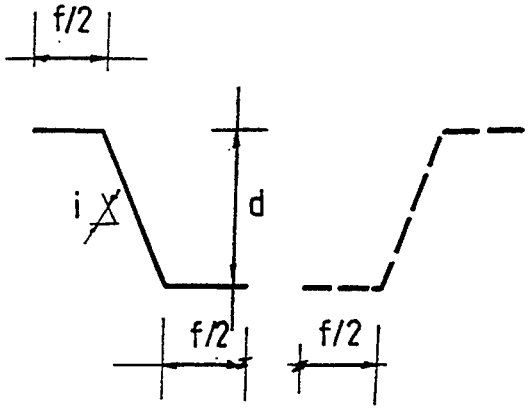

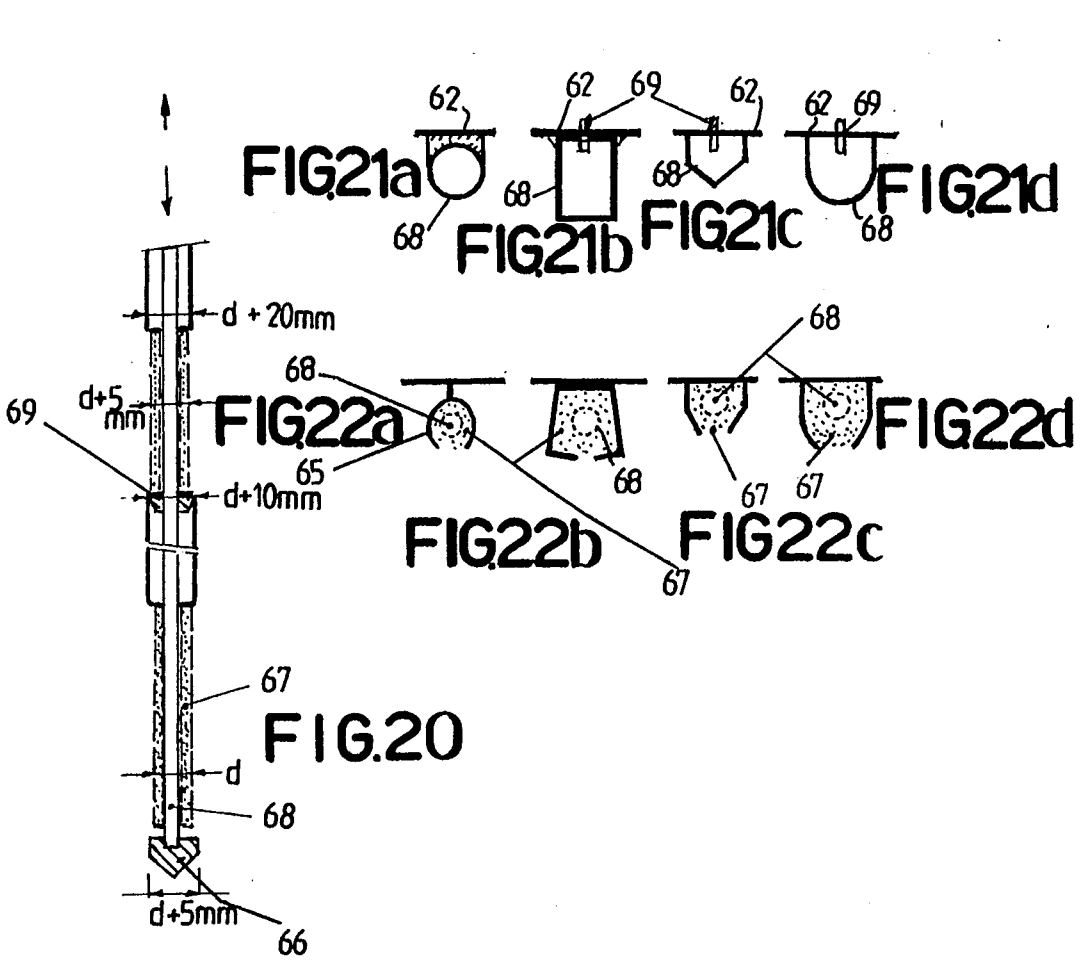
FIG.21a
FIG.21b
FIG.21c
FIG.21d
FIG.22a
FIG.22b
FIG.22c
FIG.22d
FIG.20
d + 20mm
d+5 mm
d+10mm
d
d+5mm
62
68
69
65
67
66
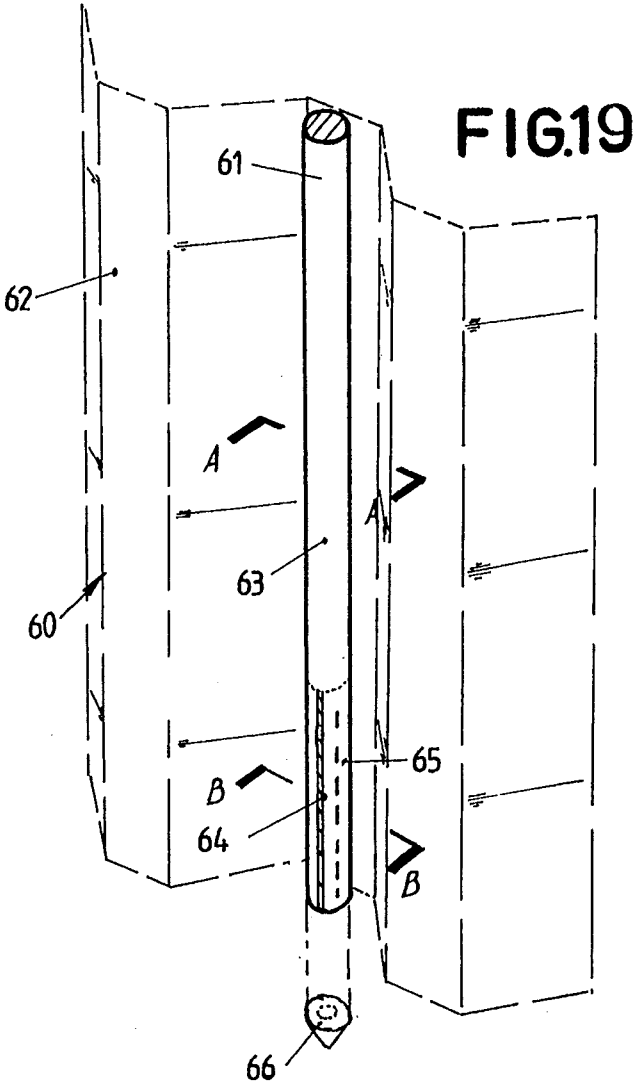
FIG.19
A
B
61
62
63
64
65
66
60

BUILDING CONSTRUCTION METHODS AND MATERIALS

TECHNICAL FIELD

This invention relates to improvements in building and civil engineering construction methods and materials particularly related to sheetpiling for ground support and site drainage.

BACKGROUND ART

Sheetpiling has been used in the construction industry for over 200 years (for example) to support excavations, create cut-offs and stabilize ground slopes. The sheetpiling can be used as either a free-standing structure or used in conjunction with tie-backs, props or ground anchors. The earth pressure and groundwater forces on the sheetpiles are dispersed along and across the sheetpiles making flexural strength of the sheetpile the main factor in design of the sheetpile.

Conventional sheetpiling consists of hot rolled steel sections (+5 mm thick) manufactured to 'unit' profiles which are linked through interlocking joints to create composite structures. Since 1933, a variety of light sheetpiles have been developed using thin (t=<5 mm), steel plate cold formed or rolled into lighter versions of conventional sheetpile profiles. Some use has also been made of pleated or corrugated profiles as light sheetpiles.

Sheetpiling can be divided into two types representing (a) the conventional sheetpiles (t>5 mm) made up of one or two basic bends to create a U or Z profile in a narrow (ws<600 mm) sheetpile that are linked with interlocking joints to form a repetitive and/or deeper section profile; and (b) the light (t=<5 mm) sheetpiles made up of a pleated, corrugated or trapezoidal profiles that repeat across a wider sheet (w=400 to 800 mm), where (t) is the thickness of the material and (w) is the effective width of the sheetpile).

Current sheetpile types are a compromise between structural capacity, lateral stability, joint design, driving capacity, manufacture and construction aspects. The types of sheetpile can be categorized by section profile parameters (d, f, i, w, n and t) and overall sheet parameters (Ws, N) as defined further below.

Conventional sheetpiles are usually made up in a single 'U' or 'Z' profile linked through the joint between sheetpiles to form a symmetrical section profile. The eccentric loads created during driving and loading of these unsymmetrical sheetpile units can be accommodated by the heavier construction of conventional (t>5 mm) sheetpiles. However, light (t=<5 mm) sheetpiles have to be formed to a symmetrical section profile to avoid eccentric loads during driving and loading of the sheetpiling. Thus the full profile has to be formed within each sheetpile, including the jointing system. On light sheetpiles (t=<5 mm), the lateral load distribution across the sheetpile has been a factor in limiting the sizing, and effective width of the profile. These two requirements have been key factors in restricting the sizing section profiles of light sheetpiles.

The structural form of the section profile adopted for sheetpiling can be related to a flange width (f) to section depth (d) by the (f/d) ratio and the web inclination (i). These parameters fit within specific ranges which determine the structural performance of the sheetpiling.

Conventional sheetpiles have adopted a limited range of flange widths (f) which results in a progressive decrease in the f/d ratio as the section depth (d) increases, viz:

| DEPTH (mm) | (f) RATIO (d) |
|---|---|
| <120 | 1.6 < f/d < 4.0 |
| 120 < d < 250 | 0.8 < f/d < 2.4 |
| 250 < d < 450 | 0.5 < f/d < 1.5 |
| 450 < d | no examples |

Light (t=<5 mm) sheetpiles have adopted a wide range of (f/d) ratios (0.3<f/d<3.5) due to the shallow (d<100 mm), profiles used in this type of sheetpile. The web inclination (i) verses (f/d) ratio reflects the limits existing on the (f/d) ratio and section depth (d).

Lateral stiffness and strength of the sheetpile control the sheetpile's effective width (ws) and thickness (t). A survey of typical sheetpiling systems indicates that conventional sheetpiles lie within sheetpile width to thickness (ws/t) ratios of 20 to 140. The (ws/t) ratio for light (t=<5 mm) sheetpiles ranges from 40 to 190. Structural Codes impose upper limits of 60 to 100 on (ws/t) ratios, although (ws/t) ratios up to 180 can be allowed in the web section of the steel beams. At the higher ratio (ws/t>100), steel structures encounter both lateral strength and stability problems.

Wider sheetpiles (ws=800 mm, ws/t>150) suffer excessive rotational deformations (∂/w>0.1), with lateral movements (∂) at the edges of sheetpiles of 80 to 100 mm occuring, even in sheetpiles supporting shallow excavations (4 m ) into favourable ground conditions. Thus overall use has imposed a limit on (ws/t) ratio of 150 to prevent a lack of lateral stiffness and stability problems. Furthermore, flexural tests on corrugated sheets have shown that load transfer across a light sheetpile becomes negligible once the (ws/t) ratio exceeds 150. Thus the outer corrugations do not contribute to the longitudinal flexural strength, due to 'curling-up' of the edge of the sheet. These tests supported the limit of 100 to 150 on the (ws/t) ratio suggested in the various Structural Codes.

The overall integrity of a sheetpile system also depends on the joint system, driving capabilities and impermeability of the insitu sheetpiling. These three factors are not usually designed, but have developed from manufacturing requirements and field experience.

The joint systems used along the edge of sheetpiles can be divided into simple 'overlap' joints, the 'hooked' joint and the 'interlocked' joint. The joints are formed as an integral part of the section profile in both conventional (t>5 mm) and light (t=<5 mm) sheetpiles. Conventional (t>5 mm) sheetpile use 'interlocked' joints based on a 'claw-paw' design moulded into the edge of the steel section. The joints take up a proportion of the material (5 to 15%) without adding to the overall width of the sheetpile. Joints can be located on either the flange or web of the sheetpile. Some joint systems reverse the sheetpile section, to create a 'double' depth sheetpile profile.

Any disengagement between adjacent sheetpiles breaks up the overall integrity of the sheetpiles, leading to a failure of the sheetpiling. The forces/movements on the joints in conventional sheetpiling can be divided into (a) tensile forces/movements (Ft) occuring from flexure of the sheetpiling, curvature in the sheetpile alignment and/or uneven earth/groundwater forces, (b)

Compression forces/movements (Fc) occurring from flexure of the sheetpiling on concave alignments or at corners and (c) outward forces (Ft) from the plane of the sheetpiling, mainly due to uneven earth or groundwater loads and secondary effects from any tensile forces/movements. On the 'wider' (w>800) and 'deeper' (d>300) profile substantial compressor/tension forces can develope across the joints from the load distribution on and across the pile. These lateral loads have been a limiting factor on the profile of 'wider' and 'lighter' sheetpiles (w/t>100). The adequacy of the various joint system under these forces varies widely, with only 'claw-paw' interlocking joints in conventional sheetpiling covering all force-movement conditions.

Jointing systems adopted on light sheetpiling are loose, with clearances exceeding 5 mm due to fold constraints for the steel sheets. Open joints fill with debris during driving which has to be displaced by the next sheetpile. This obstruction of the joint track causes opening of the joints and leads to disengagement of the sheetpiling. Joint systems adopted on light sheetpiling (+<5 mm) make no provision for the compressor/tension forces developed across the sheetpile, restricting the width (w<500 mm) and depth (d<100 mm) of the sheetpile profiles of light (+=, 5 mm) sheetpiles. Absence of an adequate jointing system has compromised the integrity of light sheetpiling since its introduction in 1933.

Sheetpiles are usually driven with impact or vibrator pile drivers. Driving forces on conventional sheetpiles (t>5 mm) are usually applied through impact blocks and jaw designs developed for normal steel piles. On light sheetpiling, the pile drivers have been limited to the lighter equipment (Qd<100 kN) using capping plates and/or profiled jaws, where Qd is the dynamic pile driving force.

Studies show that driving of the narrow (ws<600 mm) light (t=<5 mm) sheetpiles are limited by compression and buckling effects in the sheetpile. Lateral stability problems develop once the penetration slows ('refusal') as the driving force rises rapidly and onset of structural fatigue causes a failure around the top of the pile. While slippage in the pile driver's jaws reduces driving forces, the pile reaches premature refusal at shallower depth. Impact hammers do not overcome these problems as driving stresses are even higher.

Driving problems with light sheetpiles imposes a limit on the pile driving forces (Qd) equivalent to a dynamic force of 100 kN, which corresponds to 'small' vibratory pile drivers. This dynamic force allows the 'narrower' (ws<600 mm) light sheetpiles to be driven to a reasonable (8 m) depth. However, the 'wider' (ws=800 mm) sheetpiles can only be driven to shallow depth (<5 m) beyond which extensive site preparation or predrilling is required to reduce the driving resistance.

A number of light sheetpiles have incorporated a secondary corrugation in the flange of the section profile. This corrugation attempts to accommodate the eccentric driving forces occurring in the sheetpile. Depth of the secondary corrugation has been limited to half the section depth (<0.5*d). However, this stiffening of the flange has not solved eccentric load or driving problems except on shallow section profiles (d<80 mm).

Light sheetpiling is very flexible and hence the sheetpiles tend to wander off-line during driving. In moderate to hard driving conditions, the sheetpiles profile distorts and may disengage from the preceding pile due the 'weak' joint systems available for light (t=<5 mm) sheetpiling. These effects become appreciable once the effective sheetpile width (ws) exceeds 600 mm, wiht driving tolerance being poorer than +−100 mm on the long (D<7 m), wider (ws>800 mm) sheetpiles. Narrower (ws<600 mm) light sheetpiles can achieve reasonable driving tolerance (+−25 mm) with interlocked joints even on long (+7 m) sheetpiles.

A gradual wander of the sheetpile off-line is difficult to identify as no method exists of checking the final alignment of the sheetpiles before excavation. This alignment problem has hampered the use of light sheetpiles in permanent works and reinforces the limits (w & ws<600 mm) found in the section profiles of light (t=<5 mm) sheetpiling.

The lateral forces on sheetpiling depend mainly on groundwater pressures in the ground behind the sheetpiling. Thus the pressure of groundwater usually compromises the integrity of wide (ws>800) and light (t<5 mm) due to the build up of internal stresses from lateral loads developed on and within the sheetpile profile. These loads create rotational movements and buckling effect that deflects the profile and cause opening of joints in the sheetpile. Normal practice requires installation of lateral drains, deep (>10 m) wells or shallow (8 m) well points. These measures require the sheetpiling to be relatively water-tight so that water drains towards the drains or wells rather than exiting through the joints in the sheetpiling. However, draw down of the ground water may initiate subsidence in the ground behind the sheetpiling. This conflict between preserving ground water levels and the control of ground water pressure severely hampers the use of light (t<5 mm) sheetpiling.

The heavier tracks of conventional (t>5 mm) sheetpiling provides a relatively tight track which can be progressively sealed up with caulking or rubber sealants. However, the open joints occurring in light (t=<5 mm) sheetpiling cannot be effectively sealed. This problem effects the wide light sheetpiles on which alignment tolerances are poor. During driving, the simple 'overlap' joint systems separate and even 'hooked' or 'interlocked' joints may disengage leading to open joints in light (t=<5 mm) sheetpiling. Thus the groundwater has to be drawn down to a level well below the excavation level. This appreciably adds to the site dewatering costs and requires access to the area behind the sheetpiling. In all cases the dewatering of the ground behind the sheetpiling is a separate construction activity. In the past, this drainage of ground water has lead to piping erosion undermining the sheetpiling and caused excessive settlements in the ground behind the sheetpiling.

SUMMARY OF THE INVENTION

The present invention aims to overcome or alleviate one or more of the above disadvantages by providing a wide sheetpile made out of steel or other formable materials which overcomes the size limitations, stability and construction problems cited in the preceding review of the prior art.

The present invention in one aspect provides a section profile for sheetpiling made up of stiffening panels, driving ribs and the joint strips of one or more variable profiles to create an overall profile that most efficiently achieves the structural and construction requirements of a 'wide' sheetpile, for example of a width (ws) between 800 mm and 3500 mm. In a further aspect, the present invention provides stiffeners to control deformation and distortion of sheetpiles during installation and later under load. In yet a further aspect, the present invention provides the sheetpiling with joint systems of higher load capacity to accommodate the forces occurring with wide sheetpiles. The present invention also envisages the use of improved driving methods to accommodate the higher driving resistance, pile compressions and alignment problems experienced with wide sheetpiles. The present invention further provides a system for controlling groundwater flow and pressures around and behind the sheetpiling. The invention covers both conventional ($t>5$ mm) and light ($t=<5$ mm) sheetpiles.

The present invention thus provides in one preferred form a sheetpile comprising a sheet formed or folded about a longitudinal axis so as to be of corrugated profile form and having an overall width (ws) exceeding 800 mm, said sheetpile member defining stiffening panel means, driving rib means and joint strip means.

The profile and sizing of the above sheetpile can be specified by the following characteristics:

Profile sizing parameters (w, d, t, f, i, f/d, n) which relate to and define the characteristics of the stiffening panel means, driving rib means and joint strip means of the sheetpile; and overall sizing parameters (ws/tm, N,) which relate to the overall configuration of the sheetpile where, d is the depth of the profile, t is the thickness of the material forming the profile, f is the flange width of the profile, i is the angle of inclination of the web of the profile, n is the number of profiles in each of said means, tm is the minimum thickness of the sheetpile and N is the total number of profiles in said sheetpile. In a first form, the profile characteristics for each of said means, are in accordance with the following:

$d>200$ mm $t=<5$ mm $0<f<450$ mm $45<i=<90$ degrees $0<(f/d)<4$ and wherein the number n of profiles in each of said means is as follows:

$0.5<n<2$ and for the overall sheetpile;

$100<(ws/tm)$ $1=<N<5$

In a further form, said characteristics are in accordance with the following:

$d>150$ mm $t=<5$ mm $0<f<350$ mm $45<i<80$ degrees $0<(f/d)<0.8$ $100<(ws/t)$ $0.5<n<3$ $1<N<6$ In a further form, said characteristics are in accordance with the following:

$d>150$ mm $t=<5$ mm $0<f<450$ mm $45<i<60$ degrees $0<(f/d)<3$ $100<(ws/t)$ $0.5<n<3$ $1<N<6$ In a further form, said characteristics are in accordance with the following:

$d>125$ mm $t=<5$ mm $0<f<350$ mm $45<i<90$ degrees $0<(f/d)<5$ $200<(ws/t)$ $0.5<n<5$ $1<N<10$ In a further form, said characteristics are in accordance with the following:

$d>125$ mm $t=<5$ mm $0<f<450$ mm $45<i<65$ degrees $0<(f/d)<5$ $120<(w/t)$ $1<n<5$ $1<N<10$ In a further form, said characteristics are in accordance with the following:

$d>150$ mm $t>5$ mm $0<f<140$ mm $45<i<=90$ degrees $0<(f/d)<1.2$ $160<(ws/t)$ $0.5<n<3$ $1=<N<6$ In a further form, said characteristics are in accordance with the following:

$d>150$ mm $t>5$ mm $0<f<450$ mm $45<i<65$ degrees $0<(f/d)<3$ $60<(ws/t)$ $0.5<n<3$ $1=<N<6$ In a further form, said characteristics are in accordance with the following:

$d>150$ mm $t>5$ mm $0<f<300$ mm $45<i=<90$ degrees $0<(f/d)<1.2$ $100<(ws/t)$ $0.5<n<3$ $1=<N<6$ In a further form, said characteristics are in accordance with the following:

$d>150$ mm $t>5$ mm $0<f<300$ mm $45<i<65$ degrees $0<(f/d)<3$ $100<(ws/t)$ $0.5<n<3$ $1=<N<6$ In the deep profiled form, said characteristics are in accordance with the following:

$450<d<1200$ $t=>5$ mm $150<f<750$ mm $45<i<65$ degrees $0.10<f/d<2$ $60<ws/t$ $n=1$ $1=<N=<2$ Preferably, the folds in the sheet/plate follow a radium (r) of 5 to 50 mm.

In order that the invention may be more readily understood and put into practical effect reference will now be made to the accompanying drawings which illustrate preferred embodiments thereof and in which FIGS. 1*a* to 1*d* illustrate a basic section profiles defining the terminology used;

FIGS. 2*a* and 2*b* illustrate a basic profile of a sheetpiling member according to the invention;

Figure 7A:
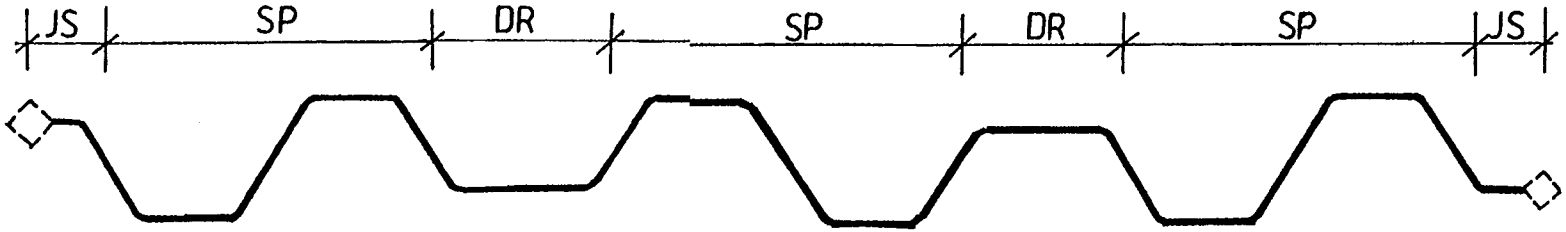
Figure 7B:
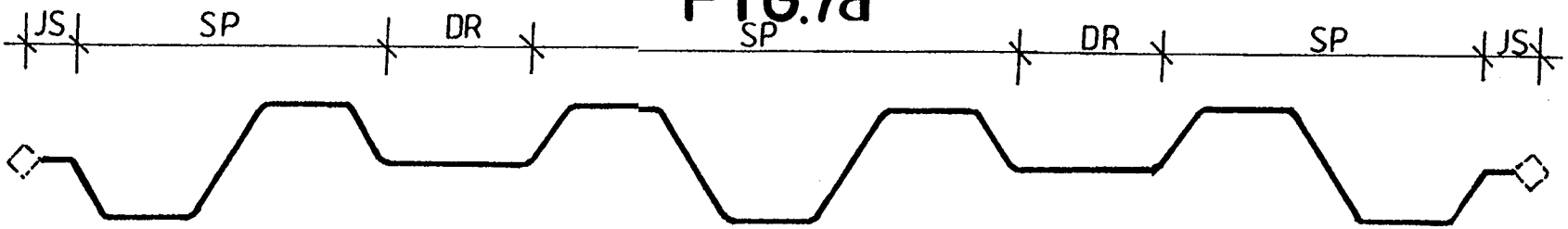
Figure 7C:
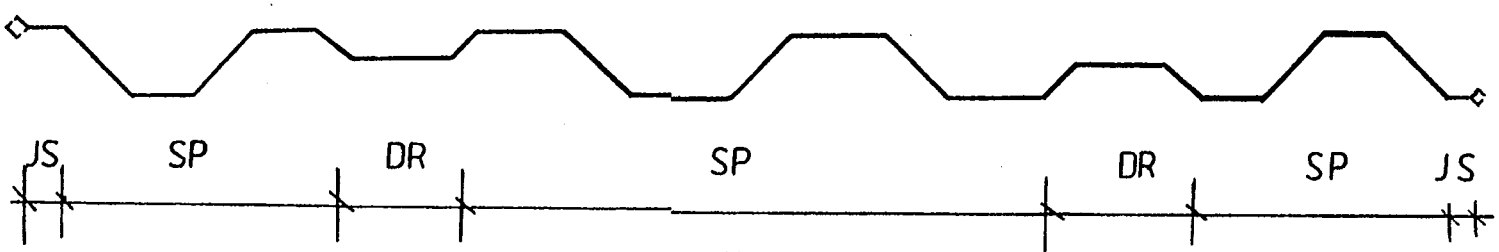
Figure 8A:
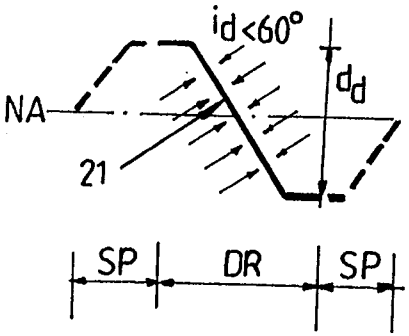
Figure 8B:
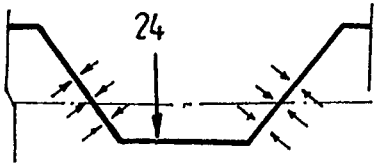
Figure 8C:
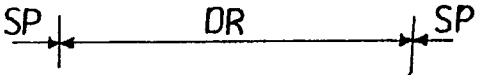
Figure 8C:
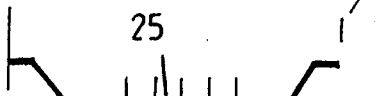
Figure 8D:
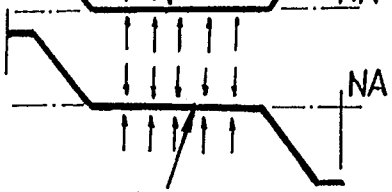
Figure 8E:
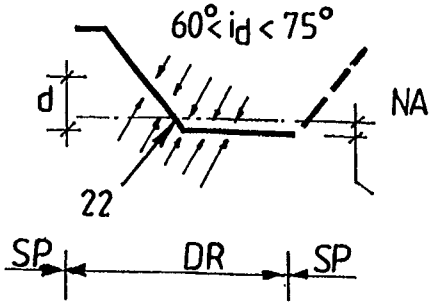
Figure 8G:
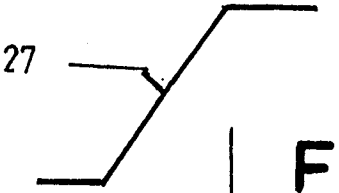
Figure 8F:
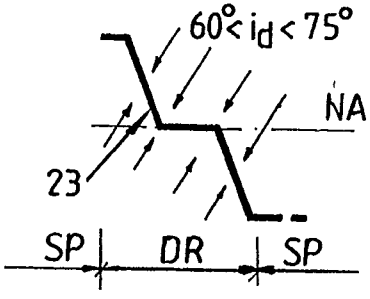
Figure 10A:
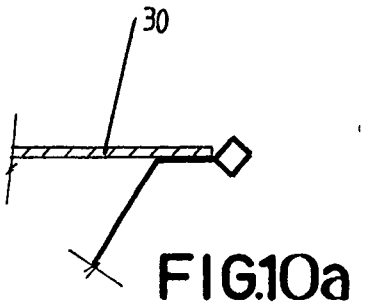
Figure 10B:
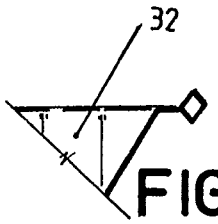
Figure 10C:
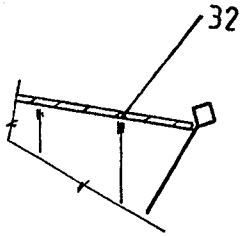
Figure 9A:
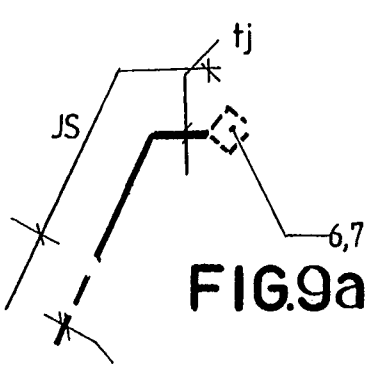
Figure 9B:
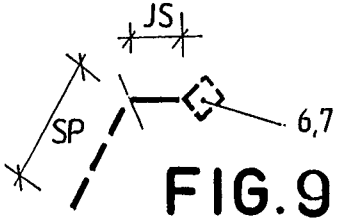
Figure 9D:
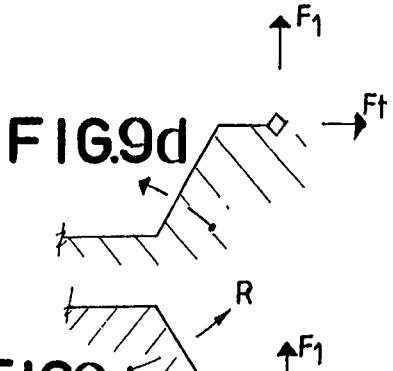
Figure 9E:
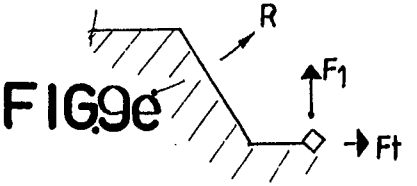
Figure 9F:
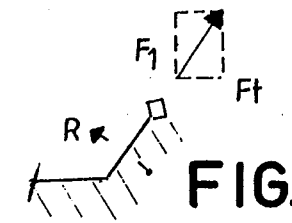
Figure 9C:
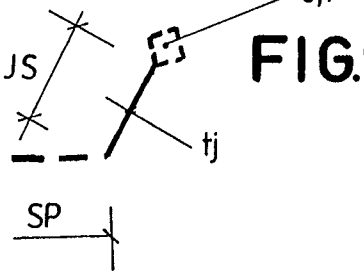
Figure 12:
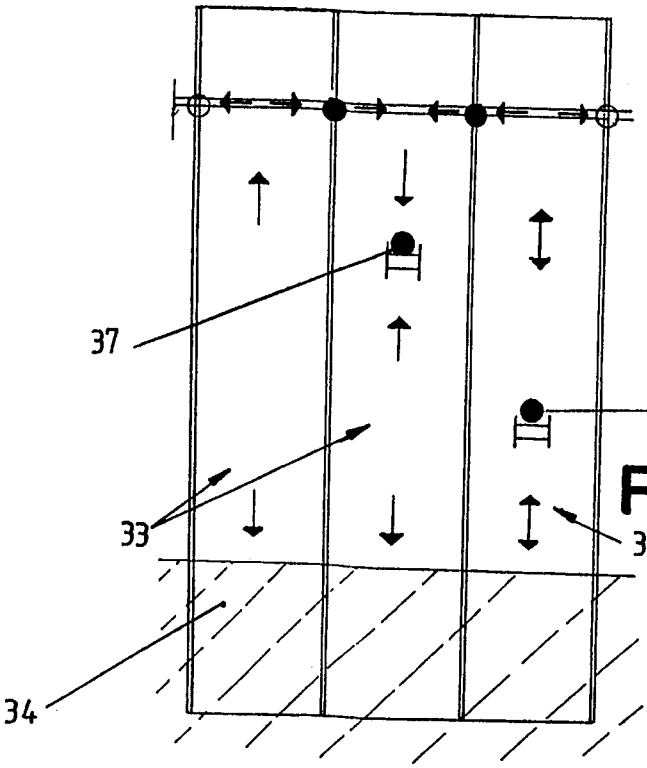
Figure 10:
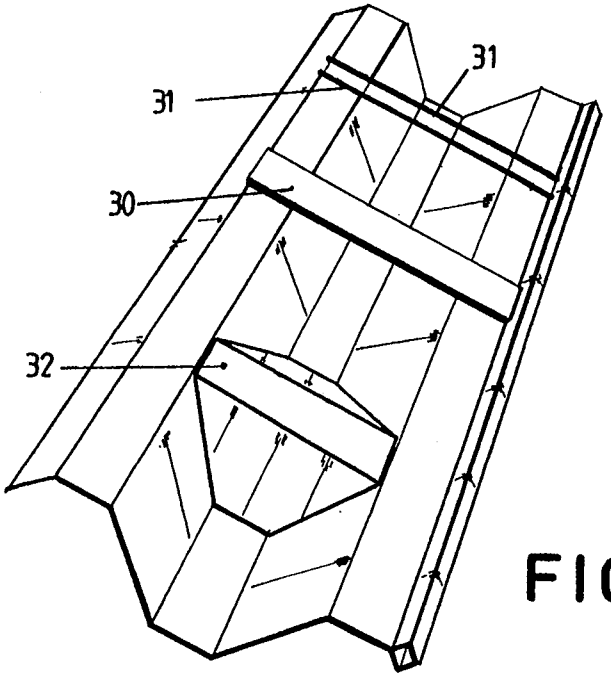
Figure 11:
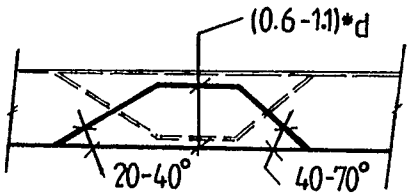
Figure 24:
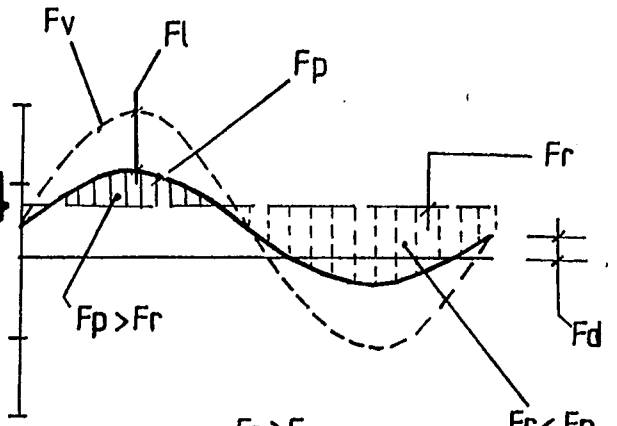
Figure 25:
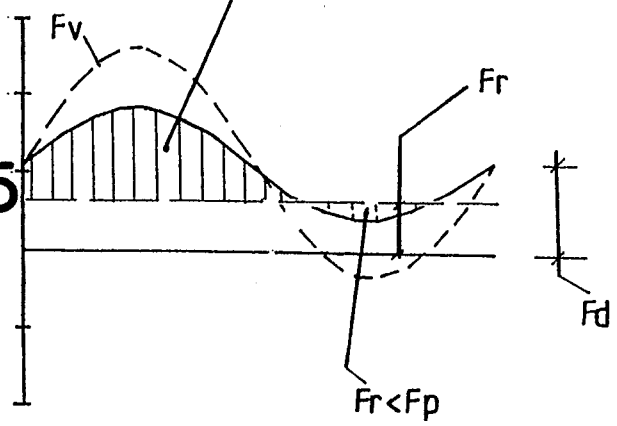
Figure 23:
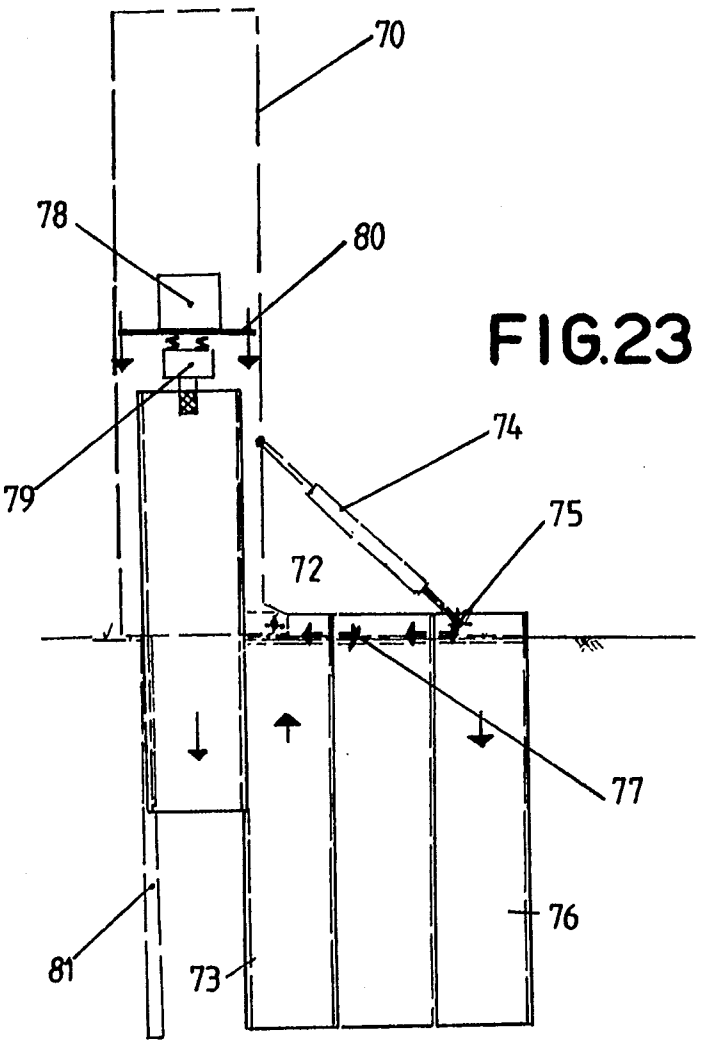
Figure 27:
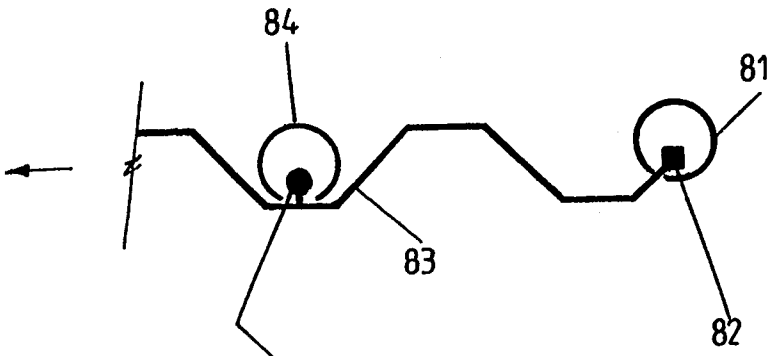
Figure 26:
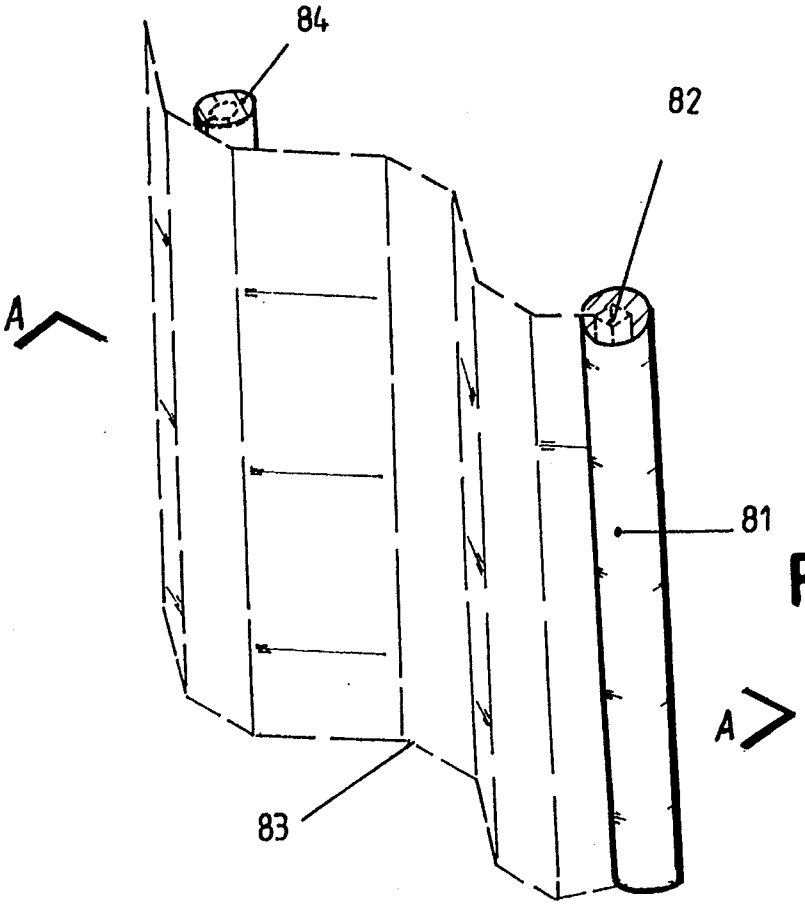

FIGS. 5*a* to 5*f* illustrate alternative basic section profiles for sheetpiling of the invention;

FIGS. 6*a* to 6*f* illustrate alternative profiles of a multiple profile sheetpiling section;

FIGS. 7*a* to 7*c* illustrate alternative profiles of a shallower profile sheetpile member;

FIGS. 8*a* to 8*g* illustrate typical driving rib profiles;

FIGS. 9*a* to 9*c* illustrate alternative locations for the joint members of the sheetpile;

FIGS. 9*d* to 9*f* are force diagrams relating to respective joint locations;

FIG. 10 illustrates in perspective view alternative stiffeners applied to a sheetpile member according to the invention;

FIGS. 10*a*, 10*b* and 10*c* illustrate end views of alternative stiffeners associated with the sheetpile;

FIG. 11 is a longitudinal sectional view showing details of the folded plate stiffener;

FIG. 12 is an elevational view showing a sheetpile member embedded in the ground and the forces associated therewith;

FIGS. 13 to 18 illustrate alternative jointing systems for the sheetpiling members of the invention;

FIG. 19 illustrates a dewatering well installation for use with a sheetpile member;

FIG. 20 illustrates an installation rod for the well;

FIGS. 21*a* to 21*d* illustrate alternative sectioned riser pipes along line A—A of FIG. 19;

FIGS. 22*a* to 22*d* illustrate alternative permeable sections along line B—B of FIG. 19;

FIG. 23 is a schematic view of a pile driving frame for use with sheetpiles of the invention;

FIGS. 24 and 25 compare the resultant pile driving forces in normal pile driving methods and pile driving using the frame of the present invention;

FIG. 26 is a perspective view of a driving guide arrangement for sheetpile driving; and FIG. 27 is a sectional view along line A—A of FIG. 26.

DETAILED DESCRIPTION OF THE INVENTION

Sheetpiles according to the present invention are defined in terms of the profile parameters, d, f, i, w, n, t and overall parameters ws, tm and N. The parameters are defined in FIG. 1*a* which shows a basic sheet corrugation profile comprising a continuous step function having a peak and a trough at which respective flanges of width f are located, the distance between the flanges and thus the section profile depth being indicated by the letter d. The flanges are joined by an inclined web having an inclination i in degrees. The overall width of the section profile is indicated by the letter w. The thickness of the material is indicated by the letter t and the number of profiles in each segment of the sheetpile by the letter n. It will be seen that the basic profile of FIG. 1*a* comprises two basic U profiles of the type shown in FIG. 1*c*. The profile of FIG. 1*b* commences at a different position along the continuous step function, and comprises two basic Z profiles of the type shown in FIG. 1*d*. The overall width of the sheetpile is indicated by the parameter ws and the total number of profiles in a sheetpile is designated N. The minimum thickness of material of the sheetpile is designated tm. The above parameters may vary between adjacent profiles and along the length of the sheetpile member.

The profile of the sheetpile member of the invention is divided into three segments providing the joint system, stiffening panels and driving ribs. The profile in its two basic forms is shown in FIGS. 2 and 5. These three segments have individual profiles tailored to suit the specific needs of the sheetpile. One or more basic section profiles for the three segments (driving, stiffening and joint) may be combined to create wide sheetpiles as shown in FIGS. 3, 4, 6 and 7 and described further below.

The profiles can be described in three sets of section profiles covering:

(a) A deep section profile consisting of a single stiffening panel with a driving rib and joint strips ($0.7 = < N = < 1.5$)—(FIGS. 2 and 5).

Figure 3:
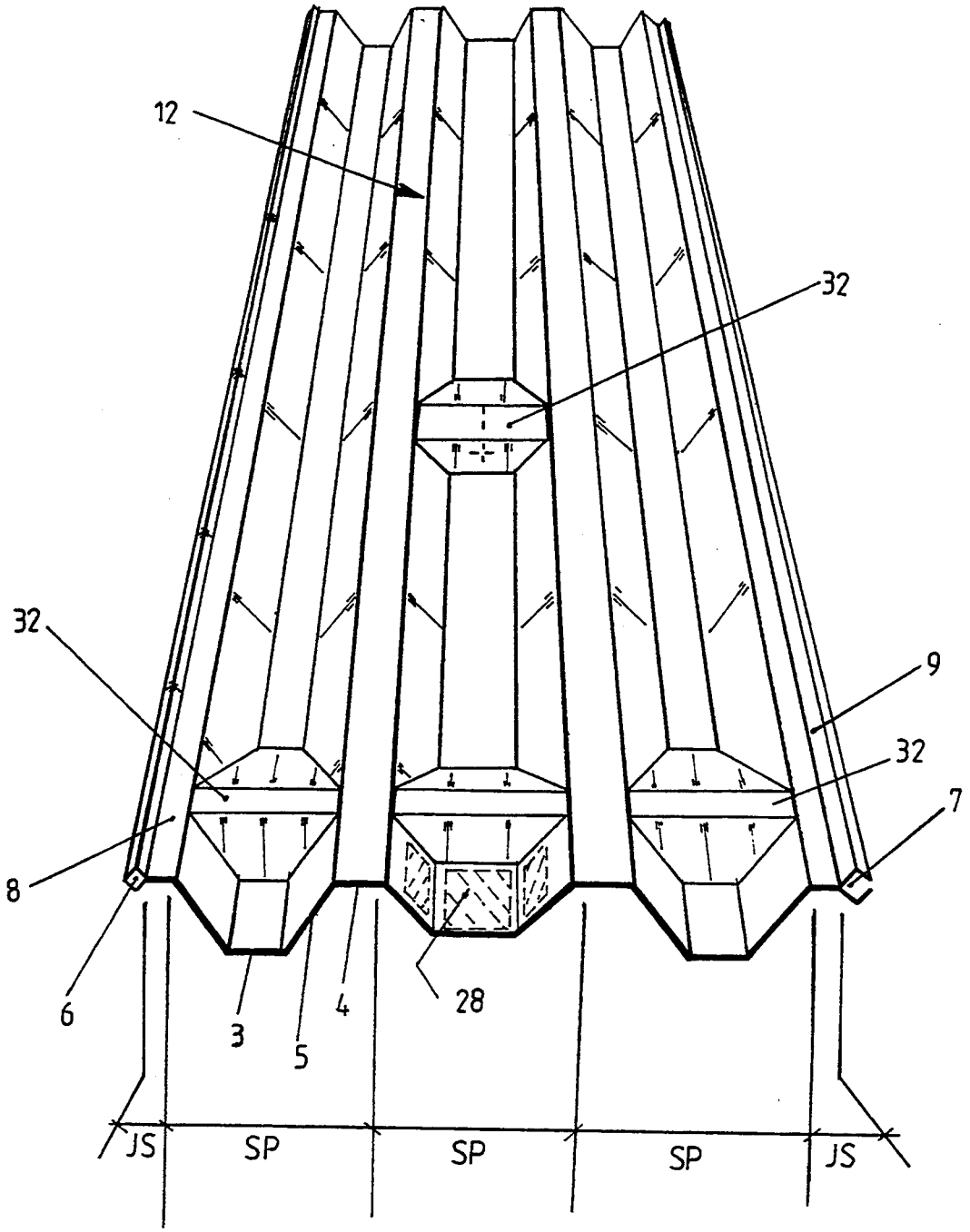
FIG. 3 illustrates multiple profiled sheetpiling member according to the invention.

(b) A multiple profile consisting of one or more stiffening panels, a driving rib and the joint strips ($1.5 < N < 5$)—(FIGS. 3 and 6)

Figure 4:
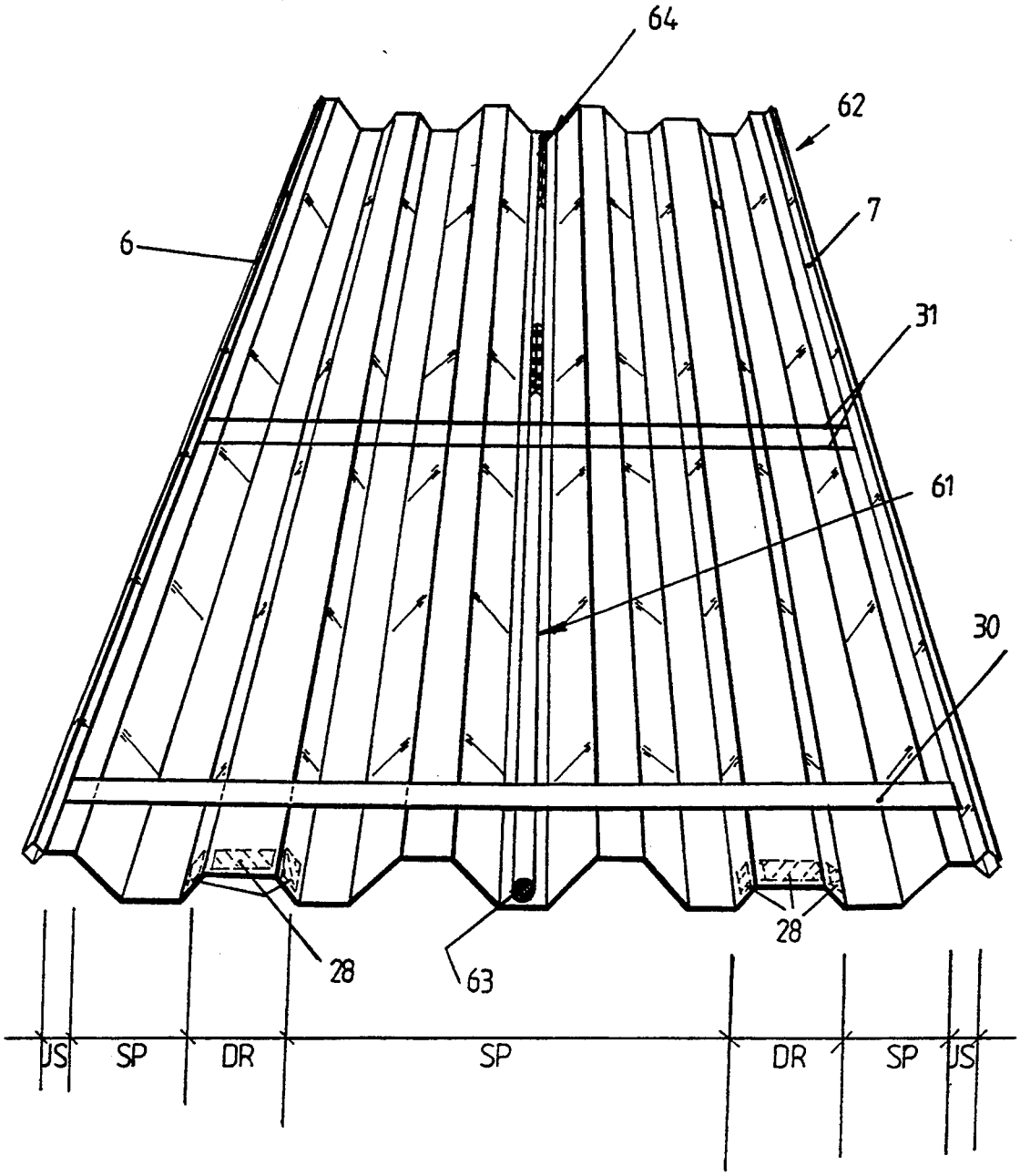
FIG. 4 illustrates a shallower multiple profiled sheetpiling member according to the invention.

(c) A shallower section profile consisting of multiple profiles ($2.5 < N$) forming two or more stiffening panels, one or more driving ribs and the two joint strips—(FIGS. 4 and 7).

Figure 2B:
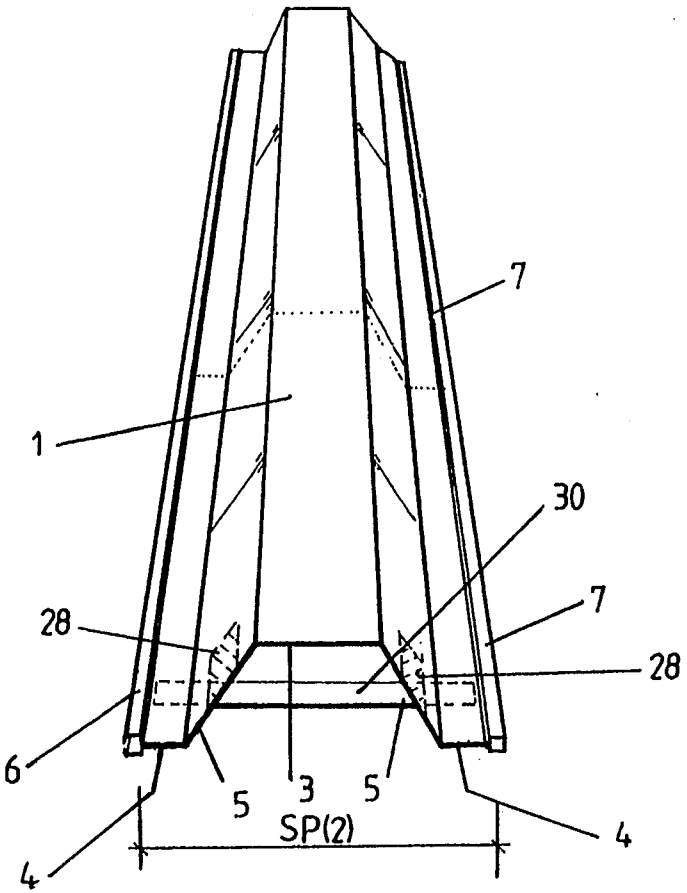
Figure 5A:
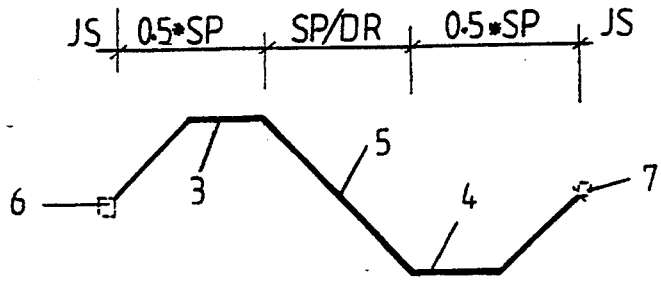
Figure 5B:
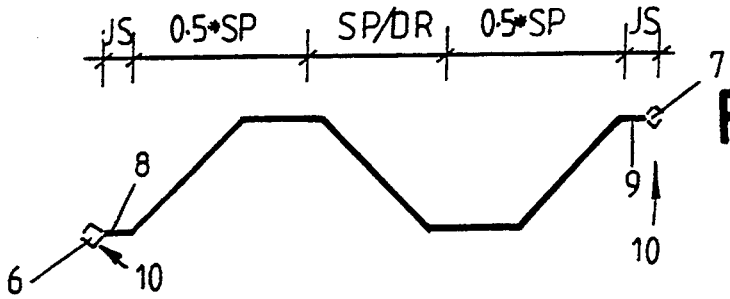
Figure 5C:
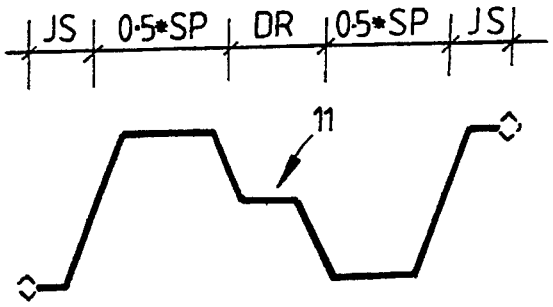
Figure 5D:
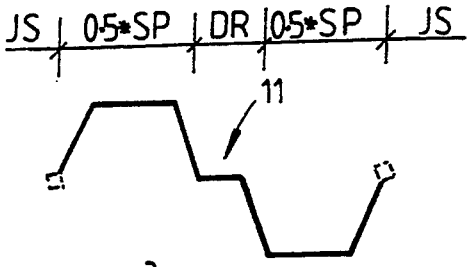
Figure 5E:
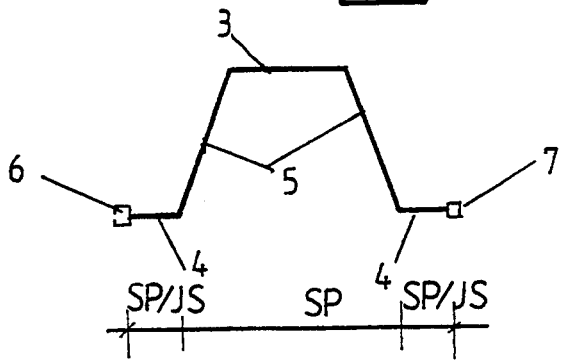
Figure 5F:
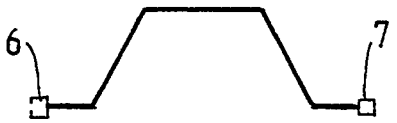
Figure 6A:
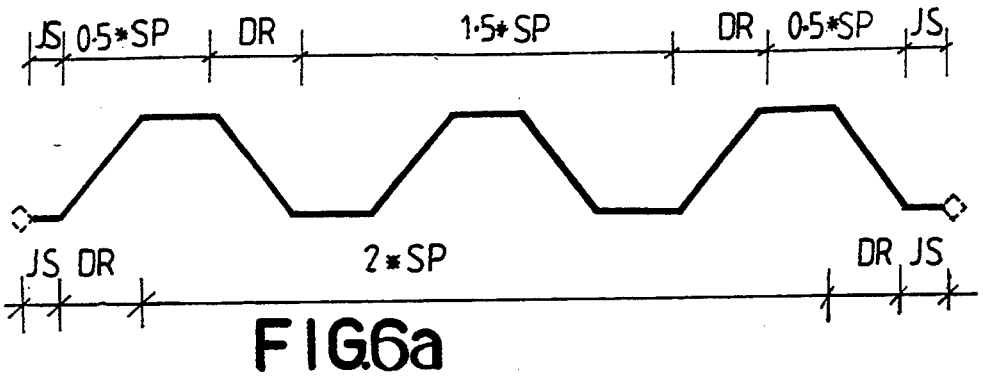
Figure 6B:
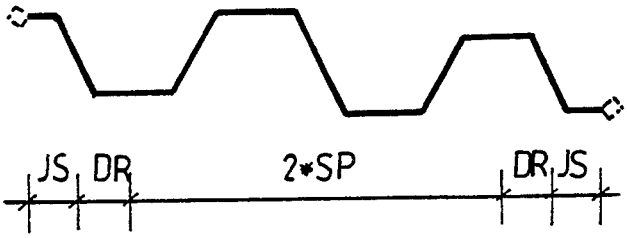
Figure 6C:
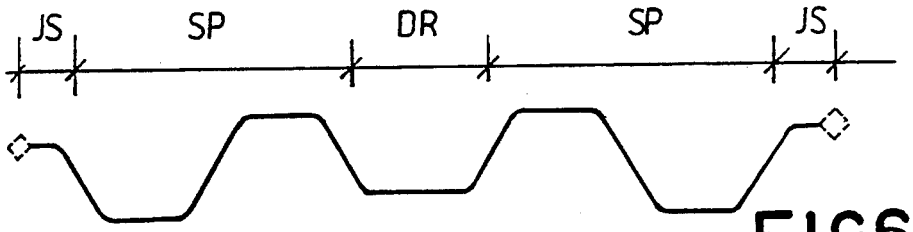
Figure 6D:
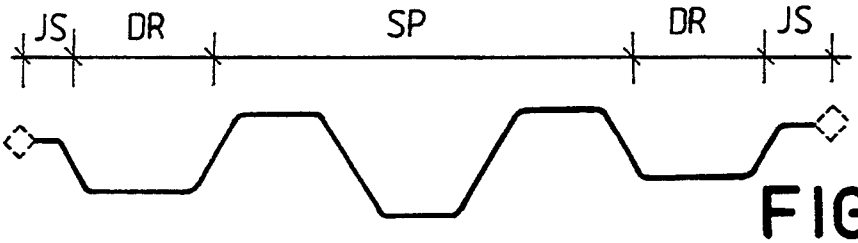
Figure 6E:
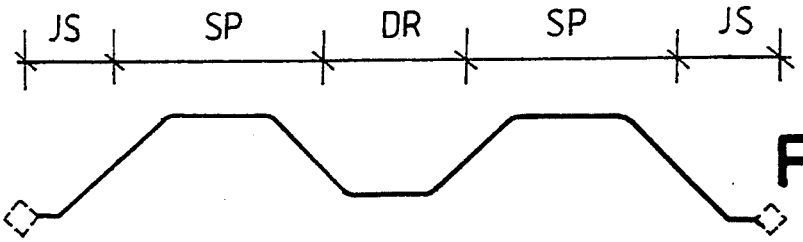
Figure 6F:
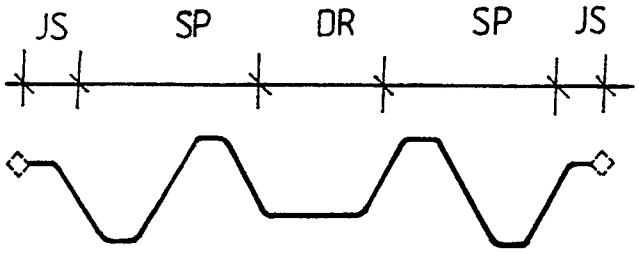

The basic sheetpiling profile shown in FIGS. 2 and 5*a* includes stiffening panels 2 designated (SP) which includes spaced flanges 3 and 4 interconnected by a joining web 5 and terminating in a complimentary jointing members 6 and 7 at opposite sides. In this basic configuration the stiffening panel 2 incorporates within the web 5, the driving rib designated (DR) for engagement by a pile driver and also incorporates jointing strips (JS) within end webs 8 and 9 or flanges 4 which terminate in the jointing members 6 and 7. In the embodiment of FIG. 5*b* the profile includes specially formed jointing strips 10 which terminate in the jointing members 6 and 7. In the embodiment of FIGS. 5*c* and 5*d* the driving rib designated as (DR) is formed with an intermediate step or corrugation 11 which lies in a plane, parallel to the upper and lower flanges 3 and 4. In the embodiment of FIG. 5*e*, the jointing members 6 and 7 have been formed on the flanges 3 and 4 to define the second basic profile—FIG. 2*b*.

Multiple profiles are formed by combining elements of the basic section profiles in various combinations as for example shown in FIG. 3 wherein the multiple profile member 12 includes two stiffening panels (SP), a single driving rib (DR) and two jointing strips (JS) terminating in the jointing members 6 and 7. Further possible multiple combination which exhibit the advantages of the invention are shown in FIGS. 6*a* to 6*f*. The embodiment of FIG. 4 and FIGS. 7*a* to 7*c* illustrate further multiple combinations according to the invention.

The deeper profiles of FIGS. 2 and 5 are designed for the high flexural strength and stiffness required in cantilever or propped sheetpiling. The multiple profiles of FIGS. 3 and 6 are used on anchored walls or trench sheeting. The shallower profiles of FIGS. 4 and 7 are designed for use as trench sheeting and seepage cut-offs. The resultant sheetpile forms the most economic sheetpile that can be created from steel or another formable materials, considering the structural characteristics, manufacture, installation and final ground support functions of the sheetpile.

The sheetpile can be made up from one or more metal sheets or plates. The sheet/plate may be formed into one or more of the segments of the section profile. These sheets/plates can be welded together longitudinally and/or transversely, such as along the dotted line shown in FIGS. 2*a* and 2*b* to form a sheetpile that is longer or wider than the individual sheets/plates. This process removes the size limitation imposed by materials and/or local manufacturing capabilities on the sheetpile profiles of the prior art. Furthermore the fabrication of the sheetpile in segments allows flexibility in section profile along and across the sheetpile. However, the sheetpile design equally applies to a sheetpile formed out of a single sheet or plate. To facilitate entry of the sheetpile into the ground the leading end thereof may be tapered in thickness.

The section profile within each segment can be made up of a part or full standard profile, or multiple profiles, usually:

| Segment | Profile (w) Units in Segment (n) |
|---|---|
| Joint Strip | 1/4 |
| Driving Rib | 1/2 |
| Stiffening Panels | $0.5 < n < 3$ |

The joint strip and driving rib, however, may be made up of any proportion of the profile unit, even in multiple units as described above. The stiffening panel has to be made up of more than half a profile unit ($n > 0.5$) in order to achieve the local and overall alignment of the stiffening panels centroid with the overall central axis of the sheetpile. Any sheetpile made up with stiffening panels of a half profile ($n = 0.5$) is unsymmetrical until the section depth of all panels is equal, that is a corrugated sheetpile.

The stiffening panels represent the main structural element of the sheetpile. Our studies have found that the structural efficiency factors (SR & FSR) of the optimal section profile lie within the following parameter ranges:

| Parameter | Strength (higher SRs) | Stiffness (max FSR) |
|---|---|---|
| Flange Width | $0 < f < 350$ | $0 < f < 200$ |
| Web inclination | $45 < i < 90$ | $55 < i < 90$ |
| (f/d) Ratio | $0 < (f/d) < 40$ | $0 < (f/d) < 1.5$ |
| Profiles | $0.5 < N < 3$ | $0.5 < N < 2$ |

However, the section depth (d) is the main factor determining the structural performance of the sheetpile.

Separation of the three functions in a "wide" sheetpile frees the section profile of the stiffening panel from the constraints of the prior art. Thus the optimal section profile can be adopted for the stiffening panel in light (t=<5 mm) sheetpiling. Sets of optimal parameters exist within these ranges for the section profiles depending on main objective, that is strength/stiffness of coverage/driving capabilities.

Thicker stiffening panels (t>5 mm) may be included in the sheetpile to cover driving forces, anchor loads and/or corrosion losses. Also the thickness (t) may be varied along a stiffening panel to match variations in flexural moments along the sheetpile and to accommodate internal stresses within the profile created by lateral forces across the sheetpile. Inclusion of 'reinforcing' plates can occur on the web or flanges to vary thickness (t) within a panel to accommodate local stress or instability problems and/or improve the overall flexural strength/stiffness of the stiffening panels. Sheetpile profiles using the heavier sheet (t>5 mm) has concentrated on the partial profile sheetpiles (N<1) to implement changes in thickness. Thus the profiles can be used in the invention for deeper (d>200 mm), wider (ws>800 mm) and heavier (t>5 mm) versions of the sheetpile profiles shown on FIG. 2, 3 and 4.

The driving rib segment (DR) of the sheetpile transmits driving forces along the sheetpile. The driving profile is determined by the pile driving equipment, in particular the jaw assembly of the pile driver. Since the driving ribs can be formed separately, the plate thickness may vary between the stiffening panels and the driving rib (td>ts). Driving methods are discussed further below.

The driving rib (DR) can be designed in four basic profiles as shown in FIGS. 8*a* to 8*g*. These four profiles can be described as:

| Profile | Location/Design |
|---|---|
| 21,22,23 | Web flat & Ve-ed or corrugated Grips |
| 24 | Split Web Grips |
| 25,26 | Flange Grips |

In these Figures, the arrows represent the gripping forces applied by the jaw of the pile driver to opposite sides of the ribs within the sheetpile. Driving ribs 21, 22 and 23 can be incorporated on a half standard profile unit (n=0.5). Hence this type of grip tends to be used on the deep profile sheetpile of FIG. 2. If the web inclination exceeds 60degrees on profile 21, the jaw assembly will interfere with the adjacent stiffening panels. However, the V-ed and corrugated web profiles 22 and 23 avoid this interference if the web inclination is less than 75 degrees.

Grip profiles 24, 25 and 26 have not been used on the profiles specified in the invention as these profiles have not been used in conventional (t>5 mm) or light (t=<5 mm) sheetpiles which links the section depths (d), dimensions (f,i), proportions [(f/d, (w/t)] and profiles (n). Nor has a heavier sheet thickness (td>t) been used before in the sheetpile around the grip area.

Incorporating two or more driving rib profiles into the wider 'wide' sheetpiles, for example of the type shown in FIGS. 6 and 7 improves the lateral stability, distributes the driving forces and controls the alignment of the sheetpile during driving. Thus incorporation of two or more driving ribs in the wide (1200<ws<3500 mm) sheetpiles avoids the use of driving caps and spreaders, particularly in conjunction with a thicker sheet (td>t) in the driving ribs. This allows a wider heavy (t>5 mm) and light (t=<5 mm) sheetpiles to be driven into harder driving conditions (Qd>1500 kN). The problem of compression buckling and vibration in the driving rib can be overcome by providing one or more longitudinal stiffeners (27) along the driving rib (see FIG. 8*g*). This stiffener may consist of a light structural section, bar or plate connected onto the sheet and running a distance (>2*d) alone the driving rib. Thus the full compression capacity of the driving rib can be developed in slender (w/t>50) driving ribs. The cross hatched areas marked 28 in FIGS. 2, 3 and 4 are the areas at which the jaws of the pile driver grip the sheetpile for driving purposes.

The joint members at opposite sides of the sheetpile may be located on either the flanges or web of the sheetpile as shown in FIG. 9. In FIG. 9*a*, the joint members are located on outer flanges, whilst in FIG. 9*b* the joint members are located on the inner flanges. In the FIG. 9*c* embodiment, the joint members are located on the webs. Light (t=<5 mm) sheetpiles tend to 'curl' under load, opening up the joints and creating forces across the joint as illustrated in FIG. 9*d* where F1 designates the lateral joint force, Ft the tension force and the arrow designated for the rotation due to flexure in the sheetpile where the joints are arranged in the web. The joint forces are less on the rear flange location.

When joints are located in the flange as in FIG. 9*c* and 9*f*, the net force is along the axes of the web therefore resulting in numeral rotation due to flexure.

The lateral distribution of load and control of the 'curling' effect is dependent on the flexural strength of the sheetpiles (first), the lateral loads and the joint location/design. The lateral transfer of load across a light (t=<5 mm) is severely restricted by the flexural strength of the sheet (0.04*t2). This problem has limited the profile width (ws) and section depth (d) of light (t=<5 mm) and conventional (5<t<10 mm) sheetpiling [(f/d)=1.0, N=1)] to:

| Sheetpiling | Profile Width (w) - (mm) | Section Depth (d) - (mm) |
|---|---|---|
| Light (3 < t < 5) | 550–800 | 125–200 |
| Conventional (5 < t < 10) | 800–1500 | 200–400 |

Thus the lateral capacity to distribute load across the profile of the joints strip becomes a major issue with wide (ws>600 mm) sheetpiles, particularly with the deeper (d>100 mm) section profiles. Thus joint design and lateral stiffness problems has restricted light sheetpiles to the narrower widths (ws>600) and shallower profiles (d<100 mm).

This problem can be partly alleviated by increasing the sheet thickness (t>5 mm). Alternatively an improvement, can be achieved in lateral capacity (F) with the use of lateral stiffeners to upgrade the lateral flexural strength of the sheet and provision of a stiffer track from structural sections to distribute the load along the sheetpile. Details of the lateral stiffeners and joint systems are discussed further below.

Also this upgrading of the lateral stiffness and strength allows the parameters defining the joint strip profiles to coincide with the relevant parameters (d, f, i)

for a stiffening panel. Thus the joint strips become part of the sheetpiles structural profile to a degree not possible to date with light (t=<5 mm) sheetpiling. On conventional sheetpiling (t>5 mm) the overall size of the section far exceeds the contribution from the joint structure to the sheetpiles structural strength. Hence a 'stable' joint is not as significant with conventional (t>5 mm) sheetpiles.

The infilling of the corrugations in the sheetpile with a web stiffener or spacer of various forms as shown in FIG. 10 creates a lateral beam across the sheetpile. These stiffeners may be either a simple plate 30 (see also FIG. 10*a*) or one or more rods 31 running across the corrugations in the sheetpile or a folded plate 32 forming a hollow panel infilling the corrugations as shown in FIGS. 10, 10*b*, 10*c* and 11. Depth of the stiffener has to lie between 60 and 110% of the section depth (d) for the stiffener to create a lateral beam across the sheetpile. The stiffener 32 extends across the stiffening panels, driving rib to the joint strips (see FIGS. 10*a* to 10*b*). The stiffener, however, may infill only one corrugation at an anchor location as shown in FIG. 10.

The stiffener may be a thick bar (wb=200 mm,t=5–10 mm) or rod 31 (dia>25 mm) which allows soil to pass up the corrugation behind the stiffener. In an alternative arrangement a structural section (I or U beam) may be profiled to infill the corrugations. However, longitudinal forces from anchor or driving loads favour the folded plate stiffener of FIGS. 10 and 11. This stiffener can be profiled (20<i <40 degrees) to minimize the soil resistance during driving and/or extraction. A vent hole or spacers may be provided to reduce soil resistance or suctions around the stiffeners. The plate stiffeners can be installed prior to driving of the sheetpile.

The load transfer achieved by the introduction of lateral stiffeners across the sheetpiles is illustrated in FIG. 12 where arrows of interconnected sheetpile 33 are shown embedded in and upstanding from the ground 34. The sheetpiles 33 are provided with transverse stiffeners 35. The double headed arrows show load transfer in both directions and single headed arrows, load transfer in one direction. Anchor/prop locations are indicated at 36 and 37.

The stiffeners may be located across the sheetpile close to the pile tip, at anchor/prop levels and/or the top of the pile (see FIG. 12.) The loads are transferred along the stiffening panels and thence by the lateral stiffeners across to the joints, anchor/props or the driving rib. The top stiffener transfers driving loads and reduce lateral vibrations. At anchor locations, the stiffeners can be used to take up the vertical component of inclined anchor or prop loads. Load capacity of the joints are locally improved (2*t2<F<200*t) by the detail proposed at the end of the stiffener on the joint panel shown in FIGS. 10*a* to 10*c*. Hence an adjacent sheetpile can be supported through the stiffener onto the adjacent anchor/propped sheetpile without resorting to 'walings'. These functions incorporate a major advantage of the stiffeners over the 'waling' beams which have to be installed during the critical stages of excavation.

The stiffeners remove the limits imposed by sheet thickness (t), allowing 'wide' (800<ws<3500 mm) sheetpiles to be formed from light (t=<5 mm) and intermediate (5<t<10 mm) sheet or plate. Additionally the lateral stability [(w/t)<150)] constraint is removed allowing wide (w<600 mm), deep (d<200 mm) profiles to be used in the stiffening panels in (ws/t) ratios exceeding 200. In conjunction with multiple driving panels, very wide sheetpiles can be driven, viz:

| Number of Anchor -Driving Panels | Sheetpiling Width (ws) - (mm) - |
|---|---|
| 1 | ws < 2000 |
| 2 | 1500 < ws < 3500 |
| 3 | 2500 < ws <+ 3500 |

Thus inclusion of web stiffeners overcomes the lateral stability problem associated with 'wide' sheetpiles.

Figure 2A:
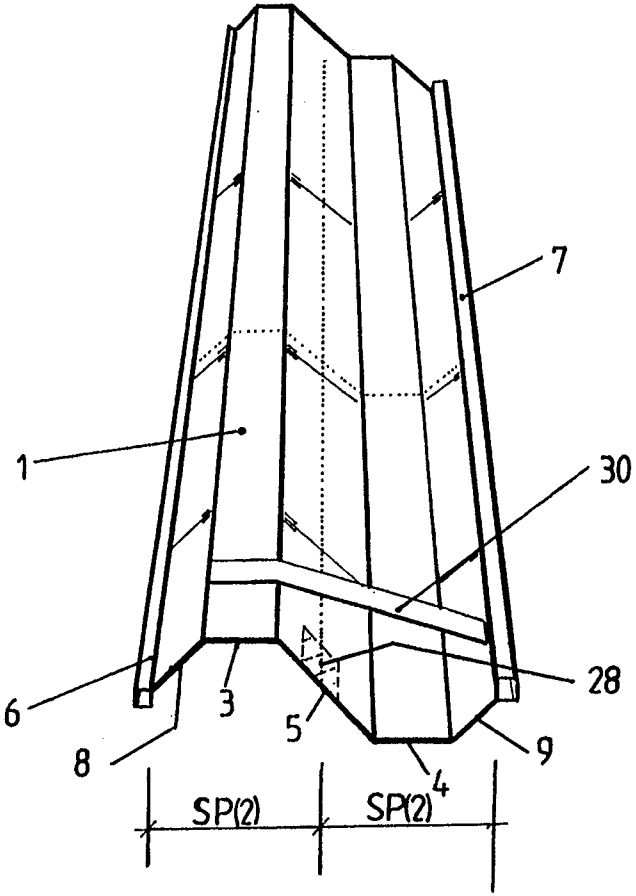

Further configurations of lateral plate stiffeners 30 are shown in FIGS. 2*a* and 2*b* and further configurations of folded plate stiffeners 32 are shown in FIG. 3. The sheetpile of FIG. 4 is provided with lateral plate stiffeners 30 as well as rod or bar stiffeners 31.

Provision of a separate joint strip (JS) in a wide sheetpile allows greater flexibility in the design of the joint system. Lateral forces between sheetpiles rapidly escalate as the sheetpiles width (ws) increased above 800 mm, viz:

| Sheetpile Width (ws) | Load across Joint (F) - (kN/m.mm) |
|---|---|
| 550 | 5*t < F < 15*t |
| 1000 | 15*t < F < 40*t |
| 2000 | 40*t < F < 70*t |
| 3000 | 80*t < F < 150*t |

The load capacity of the joint systems formed from the sheet/plate in the joint strip are limited to (F<15*t). This load capacity (F<15*t) limits this type of joint to sheetpiles widths (ws) up to 600 mm. Wider sheetpiles (ws>600 mm) require interlock joints made up of structural pipe or box sections (F<150*t). Even these joint systems have limited capacity for tension and lateral load capacity (F<30*t). Lateral load capacity can be locally improved by lateral stiffeners. However the joint system needs to be varied from the flange where high lateral loads occur (F>30*t) to the web location. At the web location a major part of the lateral load can be taken in tension/compression rather than lateral load which depends on the flexural strength of the sheet. On the web location, the load transfer can be upgraded by varying the web inclination and use of lateral stiffeners to achieve direct compression/tension which gives a high load capacity (150*t<F<200*t). Thus the joint system based on interlocked joints from pipe or box sections can be used for sheetpile widths (ws) of up to 3500 mm. On intermediate sheetpiles (800<Ws<2000 mm) the tension and compression capacity of structural pipe and box section joints allows the joints to be located on the flanges. FIGS. 13 to 28 illustrate alternative joint designs for interconnecting adjacent sheetpiles according to the invention which have higher load capacity than existing joint systems.

Figure 16:
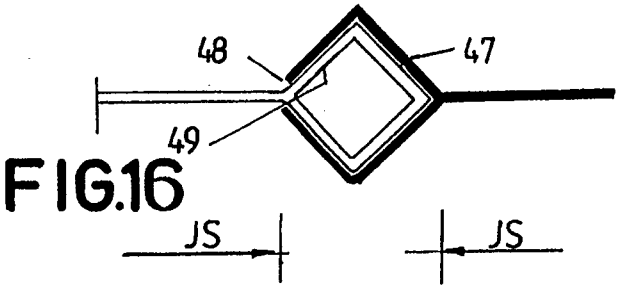
Figure 13:
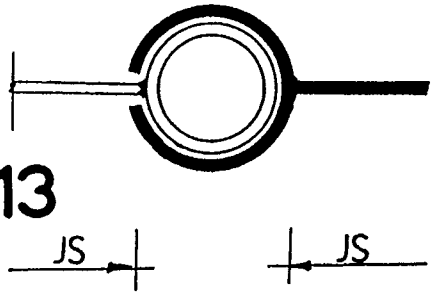
Figure 14:
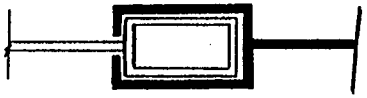
Figure 15:
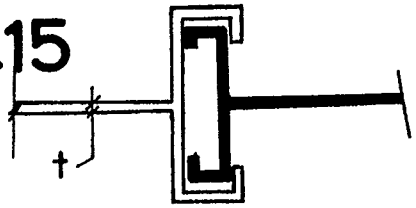

FIGS. 13, 14 and 16 illustrate joints wherein the joint stiffeners (JS) terminate in respective complementary components comprise either closed pipe sections or box sections of square or rectangular form secured to the adjacent sheetpile members with one of the sections being slotted to receive the other section. The embodiment of FIG. 15 involves the use of interlocking channel sections.

Figure 17:
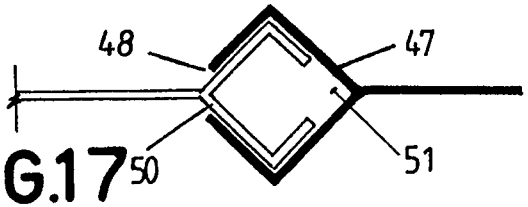
Figure 18:
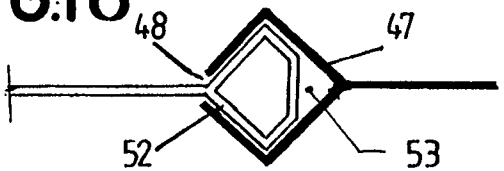

In the arrangement of FIGS. 16 to 18 one of the joint members comprises a square section 47 open along one edge 48 to receive the other joint member. In FIG. 16 the other joint members comprise a further square section 49 adapted for neat location within the other outer section 47. In FIG. 17 the other joint member 50 is of part square cross-section and open along one side edge to define a sealant space 51 with the other joint member. In FIG. 18, the joint member 52 is of truncated square cross-section to define with the other joint member a sealant space 53.

The joint designs shown in FIGS. 13 to 18, provide a tight joint fit with provision to exclude debris or soil entering into the interlock, provide a water seal if required extending along the length of the joint, allow the joint to be upgraded to suit the local engineering requirements, and form a dewatering chamber as either a separate unit or incorporated into the joint profile. These four features greatly improve the overall water tightness and integrity of the sheetpiling structure. The inclusion of a closed inner box or pipe section, allows pressure injection of drilling fluids, water and/or air to facilitate driving of the sheetpiles.

As stated above a joint sealant can be located in the open spaces formed in some joint systems—(see FIGS. 17 and 18). Also sealants can be pressure injected down the inner section of square, pipe or rectangular type joints—FIGS. 13, 14 and 15. The joint sealant can be a grease or cement-bentonite mix, a hydrophobic rubber or polymer sealant that expands with wetting. Alternatively a sealant rod or plate can be inserted into the sealant space after the sheetpile has been driven. Driving of the next sheetpile opens up the space to the ingress of groundwater activating the expanding sealants. Thus the sealant remains 'flexible' prior to and during driving of the next sheetpile.

The sheetpile may be fitted-out with a system for extraction or drainage of groundwater as shown in FIGS. 19 to 21 (and also FIG. 4). A preferred well construction 60 for dewatering consists of a pipe 61 installed in the ground behind the sheetpiling 62. This pipe 61 consists of a riser pipe 63 with one or more permeable sections 64 in the pipe 63. The permeable section 64 may be created by expanding an undersized, longitudinally split section 65 of the riser pipe 63 by driving a rod which may comprise an inner riser pipe with an oversize tip 66 down the riser pipe 63. This opens up the split in the undersize pipe allowing entry of groundwater into the pipe, However, a permeable section may be created by simply slotting the riser pipe 63.

Erosion of soil into the pipe is prevented by a permeable ceramic, granular rubber, or wire mesh, filter fabric or slotted liner 67 around an inner riser pipe 68. Entry of air into the riser pipe 68 is restricted by a water backfeed system or use of an 'high air entry' ceramic or granular rubber liner. The permeable liner may be installed by the rod and pipe 68 carrying the expanding tip 66 and collars 69 as shown in FIG. 20. Once the expanding tip 66 passes beyond the split tube section 65, the resilience of the outer tube section 65 closes the section 65 around the permeable liner holding it in place. Complete closure of the split is prevented by the permanent distortion of the split tube section 65 caused by passage of the expander tip and/or collars.

The riser pipe 68 is initially connected to the normal pipework and pump system employed on conventional vacuum well points. The riser pipe 61 may have any suitable sectional configuration as for example shown in the embodiments of FIGS. 21 and 22. Once the excavation starts, the riser pipes 68 can be tapped into as at 69 through the outer skin of the sheetpile as shown in FIG. 21. Thus long term dewatering can be achieved with a gravity system into the excavation rather than relying in the longer term on the vacuum collector system.

The installation of a well system on the sheetpiling provides effective dewatering of the ground behind the sheetpiling at low cost throughout construction. Additionally it is possible to establish negative groundwater pressures which facilitate ground support during the critical stages before the props or anchors are fully installed.

The larger pile size (ws>800 mm) increases the driving forces, mainly due to skin friction. Thus the upper levels of the driving rib are subject to the full impact of the driving forces. Furthermore, the pile has a greater tendency to wander off line. These two problems have limited the pile width (ws) and/or depths (2) attained in both light (t=<5 mm) and conventional (t>5 mm) sheetpiles. To date these driving problems have not been resolved other than by using various methods to cushion the impact from normal drop or impact hammers or provision of a reinforcing cap on the sheetpile. None of the measures are suitable to driving of light sheetpiles with vibratory pile drivers.

The driving forces for wide sheetpiles (>800 mm) are appreciably higher than encountered during driving of normal sheetpiles (ws<600 mm). Thus pile compressibility and lateral stability become key factors in the driving of the wide (ws>800 mm) sheetpile. Further the repetitive loads during driving with vibratory pile drivers create premature fatigue failures in the sheetpile. While dynamic driving forces are high (+−800 kN), the vibratory force reverses leaving only the weight of the pile driver and any push down from its mounting (Fd<50 kN) to create a 'bias' in the driving force.

Pile driving operations have shown that while vibration frequency can range from 20 to 40 Hz, 30 to 40 Hz gives optimal driving and reduces the risk of damage to the sheetpile. Also at the driving resistance levels (100<Fr<1000 kNM/m) required for 'wide' sheetpiles in most ground conditions, a positive downward push (Fd>50 kN/m) accelerates the pile driving rate and can forestall premature refusal. Thus the pile penetration has to be maintained even if it requires a heavier pile driver as very high forces occur once the pile ceases to move or becomes 'rigid'.

The present invention thus additionally provides a pile driving frame for wide sheetpiles. The pile driving frame 70 as shown in FIG. 23 includes a pull down facility in the driving frame which can develope a downward force (Fd) in excess of 100 kN/m. The driving frame 70 is secured at 72 onto the preceding driven sheetpile 73 to develope resistance to the pull-down force. The guide frame 70 is propped by means of an adjustable prop 74 secured at 75 to a more distant sheetpile 76, the lateral load being transferred by top lateral stiffener 77 across the sheetpiling to the driving frame 70.

The stationary casing of the pile driver is indicated at 78 and the vibratory casing of the pile driver at 79, whilst the arrows 80 indicate the pull down applied from the driving frame 70 to the pile driver.

The driving frame 70 actually reduces peak driving forces, fatigue effects and improves the performance of pile drivers in the 30 to 40 Hz range. Thus the necessity for driving plates, etc. can be dispensed with for wide sheetpiles. Further the improvement in pile alignment by using a driving frame allows multiple jaw system to be used on the pile driver enabling driving force to be dispersed across the sheetpile by the inclusion of several driving ribs.

FIG. 24 and FIG. 25 are force diagrams showing normal driving methods and those driving with a frame. Fp indicates the force at the top of the sheetpile and Fr the pile resistance. Fr indicates the vibrating force from the pile driver. F1 indicates loss from pile compression, Fd is the resilient pull down force.

Once the sheetpile is driven below the ground level it cannot be guided by the piling frame. Whilst the trailing edge of the sheetpile follows the joint member on the previous sheetpile, the leading track is free to wander off-line. Potential wander in the sheetpile at a depth (1) of 6.0 m would typically be:

| Sheetpile Width (ws) - (mm) | Wander (mm) at 6.0 m |
|---|---|
| 1000 | 30 |
| 2000 | 120 |
| 3000 | 300 |

Since the wander occurs from torsional twist, it cannot be controlled by stiffeners across or along the sheetpile, although the top stiffener reduces the wander.

The proposed design uses the interlock joint system described above with reference to FIGS. 13 to 18 in conjunction with a split guide tube 81 of 75 to 250 mm in diameter shown in FIGS. 26 and 27 to extend the control of the lateral alignment of the sheetpile below the ground surface. The split may be along the axis of the tube wall or follow a gradual spiral. The split tube 81 is initially installed by a drill rig on the proposed alignment, as shown in FIG. 28, the tube 81 being rotated to achieve vertical or lateral alignment. The leading edge track 82 of the sheetpile 83 is then driven down the split and thence the tube 75 is extracted, usually by the pile driver. This method minimizes the wander on the end of wide piles (ws>800 mm). Intermediate guides 84 may be provided on dewatering well tubes giving intermediate restraint to very wide (ws>2000 mm) sheetpiles. Thus any sheetpile can be installed to accurate (+−25 mm) lateral alignments even at depth (1>6 m).

The overall advantages of wide (ws>800 mm) light (t=<5 mm) sheetpiles are best illustrated by the cost comparison with normal light (t=<5 mm) and conventional sheetpiles. A wide range of sheetpile applications have been costed for both light and conventional sheetpiles on sites in America, SE-Asia and Australasia. All applications show a cost of between 60 and 90%, averaging 70% of conventional sheetpiles, even on sites where the sheetpiling is recovered on completion of the excavation. This saving is incurred in lower material costs, driving costs and prop/anchor costs. Also structural performance of the lighter (t<10 mm) sheetpiling has been improved to at least that of conventional sheetpiling.

The proposed design for a 'wide' sheetpile eliminates the shortcomings of other light (t=<5 mm) sheetpiles. These include improvements in structural parameters, lateral stability, joint systems and watertightness. Overall costs are lower due to savings on driving costs and ancillary works (walings, props, anchors etc.). However, the main advantage lies in the upgrading of light (t=<10 mm) sheetpiles to the integrity of conventional sheetpiling systems. Even in the range of conventional sheetpiles (t>5 mm) the performance of the proposed design for a 'wide' sheetpile is superior to the conventional sheetpile designs contained in the prior art.

The present invention thus provides a wide (ws>800 mm) sheetpile formed from steel plate folded or formed to a variable profile which imparts driving, bending and lateral strength not achieved with previous profiles for this type of sheetpiling. The design divides the sheetpile into three panels, viz: driving rib, stiffening panels and jointing strips. Also a sheetpiles has specific requirements around the pile tip, in the centre segment and at the top of the sheetpile. The design concept further divides the sheetpile into three levels. The sheetpile can be manufactured by either folding or forming the overall profile from one metal plate or by joining modular panels to create a wide (ws>800 mm) sheetpile in long lengths (>4 m). The material thickness (t) may vary across and/or along the sheetpile to suit the specific requirements of the various panels and/or levels.

We claim:

1. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$$d>200 \text{ mm}$$

$$t=<5 \text{ mm}$$

$$0<f<450 \text{ mm}$$

$$45<i=<90 \text{ degrees}$$

$$0<(f/d)<4$$

where, d is the depth of the profile, t is the thickness of the material, f is the flange width, i is the angle of inclination of the web, and wherein the number n of said profiles in each of said means is in accordance with the following:

$$0.5<n<2$$

and wherein for said sheetpile $$100<(ws/tm)$$

$$1=<N<5$$

wherein tm is the minimum thickness of the sheetpile and N is the number of said profiles in said sheetpile.

2. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$$d>150 \text{ mm}$$

$$t=<5 \text{ mm}$$

$0<f<350$ mm $45<i=<80$ degrees $0<(f/d)<0.8$ where, d is the depth of the profile, t is the thickness of the material, f is the flange width, i is the angle of inclination of the web, and wherein the number n of said profiles in each of said means is in accordance with the following:

$0.5<n<3$ and wherein for said sheetpile $100<(ws/tm)$ $1=<N<6$ wherein tm is the minimum thickness of the sheetpile and N is the number of said profiles in said sheetpile.

3. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>150$ mm $t=<5$ mm $0<f<450$ mm $450<i=<60$ degrees $0<(f/d0<3$ where, d is the depth of the profile, t is the thickness of the material, f is the flange width, i is the angle of inclination of the web, and wherein the number n of said profiles in each of said means is in accordance with the following:

$, 0.5<n<3$ and wherein for said sheetpile $100<(ws/tm)$ $1=<N<6$ wherein tm is the minimum thickness of the sheetpile and N is the number of said profiles in said sheetpile.

4. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>125$ mm $t=<5$ mm $0<f<350$ mm $45<i=<90$ degrees $0<(f/d)<5$ where, d is the depth of the profile, t is the thickness of the material, f is the flange width, i is the angle of inclination of the web, and wherein the number n of said profiles in each of said means is in accordance with the following:

$0.5<n<5$ and wherein for said sheetpile $200<(ws/tm)$ $1=<N<10$ wherein tm is the minimum thickness of the sheetpile and N is the number of said profiles in said sheetpile.

5. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>125$ mm $t=<5$ mm $0<f<450$ mm $45<i=<65$ degrees $0<(f/d)<5$ where, d is the depth of the profile, t is the thickness of the material, f is the flange width, i is the angle of inclination of the web, and wherein the number n of said profiles in each of said means is in accordance with the following:

$1<n<5$ and wherein for said sheetpile $120<(ws/tm)$ $1=<N<10$ wherein tm is the minimum thickness of the sheetpile and N is the number of said profiles in said sheetpile.

6. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>150$ mm $t=>5$ mm $0<f<140$ mm $45<i=90$ degrees $0<(f/d)<1.2$ where, d is the depth of the profile, t is the thickness of the material, f is the flange width, i is the angle of inclination of the web, and wherein the number n of said profiles in each of said means is in accordance with the following:

$0.5<n<3$ and wherein for said sheetpile $160<(ws/tm)$ $1=<N<6$ wherein tm is the minimum thicknes of the sheetpile and N is the number of said profiles in said sheetpile.

7. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>150$ mm $t=>5$ mm $0<f<450$ mm $45<i<65$ degrees $0<(f/d)<3$ where, d is the depth of the profile, t is the thickness of the material, f is the flange width, i is the angle of inclination of the web, and wherein the number n of said profiles in each of said means is in accordance with the following:

$0.5<n<3$ and wherein for said sheetpile $60<(ws/tm)$ $1=<N<6$ wherein tm is the minimum thickness of the sheetpile and N is the number of said profiles in said sheetpile.

8. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>150$ mm $t=>5$ mm $0<f<300$ mm $45<i=<90$ degrees $0<(f/d)<1.2$ where, d is the depth of the profile, t is the thickness of the material, f is the flange width, i is the angle of inclination of the web, and wherein the number n of said profiles in each of said means is in accordance with the following:

$0.5<n<3$ and wherein for said sheetpile $100<(ws/tm)$ $1=<N<6$ wherein tm is the minimum thickness of the sheetpile and N is the number of said profiles in said sheetpile.

9. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$450<d<1200$ $t>5$ mm $150<f<750$ mm $45<i<65$ degrees $0.1<(f/d)<2$ where, d is the depth of the profile, t is the thickness of the material, f is the flange width, i is the angle of inclination of the web, and wherein the number n of said profiles in each of said means is in accordance with the following:

$n=1$ and wherein for said sheetpile $60<(ws/tm)$ $1=<N=<2$ wherein tm is the minimum thickness of the sheetpile and N is the number of said profiles in said sheetpile.

10. A sheetpile comprising a sheet formed or folded about a longitudinal axis so as to be of corrugated profile form and having an overall width (ws) exceeding 800 mm, said sheetpile defining stiffening panel means, driving rib means and joint strip means, and characterized in that the profile for each of said stiffening panel means, driving rib means and joint strip means is in accordance with the following:

$d>150$ mm $t=>5$ mm $0<f<300$ mm $45<i<65$ degrees $0<(f/d)<3$ where, d is the depth of the profile, t is the thickness of the material, f is the flange width, i is the angle of inclination of the web, and wherein the number n of said profiles in each of said means is in accordance with the following:

$0.5<n<3$ and wherein for said sheetpile $100<(ws/tm)$ $1=<N<6$ wherein tm is the minimum thickness of the sheetpile and N is the number of said profiles in said sheetpile.

11. A sheetpile according to any one of claims 1 to 10 wherein the folds in said sheet follow a radium (r) of 5 to 50 mm.

12. A sheetpile according to any one of claims 1 to 10 and including stiffening means extending laterally of said sheetpile and secured thereto.

13. A sheetpile according to claim 12 wherein said stiffening means includes one or more plate members extending across corrugations in said sheetpile.

14. A sheetpile according to claim 12 wherein said stiffening means includes one or more bars or rods extending across corrugations in said sheetpile.

15. A sheetpile according to claim 12 wherein said stiffening means including one or more folded plates configured to infill corrugations in said sheetpile.

16. A sheetpile according to any one of claims 1 to 10 wherein said joint strip means include joint members at opposite side edges of said sheet pile for interconnecting adjacent said sheetpile.

17. A sheetpile according to claim 16 wherein said joint members comprise complementary male/female members for enabling adjacent said sheetpiles to be slidably interconnected lengthwise.

18. A sheetpile according to claim 16 wherein said male/female members comprise tubular sectioned members of circular section.

19. A sheetpile according to claim 17 wherein said male/female members form therebetween a sealant space for receipt of a sealant.

20. A sheetpile according to any one of claims 1 to 10 and including dewatering means secured to one side of said sheetpile for removing groundwater.

21. A sheetpile according to claim 20 wherein said dewatering means includes a tubular member secured to one side of said sheetpile member, said tubular having a permeable section.

22. A sheetpile according to claim 21 wherein said tubular member is slotted to define said permeable section.

23. A sheetpile according to claim 21 and including filter means within said tubular member adjacent said permeable section.

24. A sheetpile according to claim 17, wherein said male/female members comprises tubular sectioned members of rectangular cross-section.

* * * * *